US005932822A

United States Patent [19]

Bernstein

[11] Patent Number: 5,932,822

[45] Date of Patent: Aug. 3, 1999

[54] LOCKING NUT ASSEMBLY FOR MUSICAL STRINGED INSTRUMENTS

[76] Inventor: Steven J. Bernstein, 251 Royal Poinciana Way, Apt. A, Palm Beach, Fla. 33480

[21] Appl. No.: 08/884,159

[22] Filed: Jun. 27, 1997

[51] Int. Cl.[6] ..... G10D 3/06

[52] U.S. Cl. ..... 84/314 N; 84/318

[58] Field of Search ..... 84/314 N, 318

[56] References Cited

U.S. PATENT DOCUMENTS

| | | | |
|---|---|---|---|
| 4,517,874 | 5/1985 | Fender | 84/314 N |
| 4,579,033 | 4/1986 | Edwards | 84/314 N |
| 4,667,561 | 5/1987 | Storey et al. | 84/314 N |

*Primary Examiner*—William M. Shoop, Jr.
*Assistant Examiner*—Shih-yung Hsieh
*Attorney, Agent, or Firm*—Malin, Haley, DiMaggio & Crosby

[57] ABSTRACT

A manual string locking assembly for clamping the strings of a musical instrument, such as a guitar, adjacent to the fretboard nut of the instrument is disclosed. The string locking assembly is mounted on the headstock of the guitar between the fretboard nut and tuning pegs. The assembly includes a clamping block, having front and rear pillars for easy self-alignment of the strings, mounted directly to the headstock of the guitar to support an adjustable finger operated clamping device which can accommodate strings of varying diameters. A single spring loaded revolvable key operates three machine threaded cam-action flat head cap screws. The three screws are disposed either in an unlocked position to allow free tuning of the strings of the guitar or in a secured locked position to provide a grip between the clamping block and three threaded base-plate tabs to prevent slippage of the strings while the instrument is being played. The key supplies a hex-head insert for adjustment of the locking screws. Once a locking screw is properly adjusted, the key can be translated in a linear motion along the clamping block railing and dropped into the next hex-head cavity by a compression spring housed within the key assembly.

20 Claims, 4 Drawing Sheets

LOCKING NUT ASSEMBLY FOR MUSICAL STRINGED INSTRUMENTS

BACKGROUND OF THE INVENTION

1. Field of the Invention

The present invention relates generally to musical stringed instruments and particularly to a string lock assembly for selectively locking and maintaining the strings of a musical instrument against slippage during instrument utilization.

2. Description of the Background Art

Many guitarists and bassists utilize adjustable bridge assemblies or tremolo devices with their instruments to provide for varying string tension and oscillatory motion which allows a note being played to be decreased or increased in pitch or for achieving some other tremolo affect. One problem known with the use of these assemblies and devices is that the strings do not always return to their proper pitch with release of the vibrato arm with the ultimate affect of the instrument coming out of tune.

To overcome the problem of the instrument coming out of tune when utilizing an adjustable bridge assembly or tremolo device, several devices have been developed that are intended to utilize a mechanism designed to lock in place the strings of musical instruments after the strings have been initially tuned.

U.S. Pat. No. 4,171,661 granted to Rose on Oct. 23, 1979 entitled "Guitar Tremolo Method And Apparatus" discloses an anchoring device that locks the strings in place with the use of a threaded clamping device. With the Rose device the conventional fretboard nut is replaced by a special locking nut assembly with a series of blocks held by single bolts or screws for clamping the strings of a guitar at the end of the guitar's neck. Several disadvantages are readily apparent with the Rose device. For example, in order to re-tune a guitar with the Rose device, it is necessary to use a separate wrench or screwdriver to loosen the blocks and allow adjustment of the strings in tension. Such a time consuming and tedious operation is particularly inconvenient during a live performance, rehearsal, lesson, etc. Furthermore, as stated above, the Rose device requires replacement of the conventional fretboard nut.

U.S. Pat. No. 4,475,432 granted to Stroh on Oct. 9, 1984 entitled "String-Clamping Means" discloses a series of blocks that are clamped together and anchor the strings mounted between the blocks. A threaded bolt serves to tighten the blocks for anchoring and releasing tension on the strings.

U.S. Pat. Nos. 4,574,678 and 4,579,033 granted on March 11 and Apr. 1, 1986, respectively, to Edwards and respectively entitled "String Locking Assembly For A Musical Instrument" and "Locking Nut Assembly For A Guitar", respectively disclose a locking nut assembly to be used behind the guitar's original fretboard nut and in place of the guitar's original fretboard nut. Both devices include a base-plate that is mounted directly to the guitar. The base-plate includes an outwardly disposed surface for supporting the guitar strings and outwardly extending posts at spaced intervals. The posts separate the individual strings. The Edwards devices also include cam action locking devices which serve to lock the strings in place after they have been tuned. In both of the structures disclosed in these patents, the lever tabs are very small and hence, are cumbersome to operate, making the ability to manually apply sufficient torque by manipulation of the fingers difficult. Furthermore, because the lever tabs are nearly flush with the fretboard and may be fulcrumed in the direction of the first fret, this structure interferes with fretting the fingerboard in this location and hence, obstructs the musician's ability to play the instrument. Moreover, the tabs have the propensity of colliding with each other. To avoid this collision the adjacent tabs must be pivoted in opposite directions. In the event immediate pivoting of the tabs cannot be accommodated, the tab is left in an erect position or torqued until it can be pivoted for clearance at a later time. A possible result of this circumstance is that the threads of the locking screws may become stripped.

U.S. Pat. No. 4,667,561 granted to Storey et al discloses a string lock device that includes a plurality of adjustable cam-shaped lever and wedge combinations that lock and release the strings of a guitar. By manually rotating the levers to an overcenter position, the wedges are displaced longitudinally which, in turn, displace the clamping screws and block assemblies for clamping the strings between the clamping blocks and the string lock base. In this procedure when the levers are rotated and the wedges are horizontally displaced forward, there is a tendency for the levers to react in an opposite direction. The torque of these levers transfers a force upon an axial pin or journal that accommodates the stress of the levers when in the locking position. This force is sufficient enough to cause failure to the clamping block.

All of the above-described devices are relatively cumbersome to operate or tend to fail and/or have the propensity of interfering with the playing of the stringed instrument. Furthermore, in designs where the locking clamp has been made integral with the fretboard nut, the ability of filing the fretboard nut to achieve the desired clearance between the strings and the first fret of the guitar or stringed instrument may be interfered. Additionally, in certain instruments that include an adjustable truss rod assembly running within the length of the neck for controlling the curvature of the neck, the previous locking mechanism often obstructs this truss adjustment mechanism.

Because the nut of the instrument must be designed for specific spacing between the strings and the string lock requires a set arc of the strings across the width of the fingerboard, the use of previous integral locking devices required different string locks of different designs for different guitar necks and fingerboards.

Thus, some of the problems with previous devices include, but are not limited to, that the locking nut has a tendency of loosening, breakage thereto is relatively frequent, and/or that the device(s) is(are) not convenient to adjust. In certain previous locking devices a separate tool is required to make the adjustment. Not only is the fact that the tool may not be available for one reason or another, manipulating the tool by one's fingers may not enable the user to provide sufficient torque to assure that the clamping force will satisfy the locking requirements.

While previous locking devices may operate satisfactory under some circumstances, they are all rather unwieldy to operate, and usually require a separate tool for providing clamping force. Moreover, previous string locks which comprise the nut of the instrument, usually are required to be designed for specific spacing between the strings, thus, dictating to the user the spacing of the strings. Additionally, previous nut mounted string locks require a set arc of the strings across the width of the fingerboard, requiring different designed devices for different guitar necks and fingerboards.

Thus, what is needed in the art is an adjustable string clamping mechanism which is quickly and easily manually operated to securely anchor the strings of a musical instrument, without any modifications to the instrument. It is therefore, to the effective resolution of the aforementioned problems and shortcomings that the present invention is directed.

SUMMARY OF THE INVENTION

The present invention discloses a manual string locking assembly for clamping the strings of a musical instrument, such as a guitar, adjacent to a fretboard nut of the instrument. The string locking assembly is preferably mounted on a headstock of the guitar between the fretboard nut and tuning pegs.

The assembly generally includes a clamping block, having front and rear pillars for easy self-alignment of the strings. The clamping block is preferably mounted directly to the headstock of the guitar to support an adjustable finger operated clamping device which can accommodate strings of varying diameters. A single spring loaded revolvable key preferably operates three machine threaded cam-action flat head cap screws. The three screws are disposed either in an unlocked position to allow free tuning of the strings of the guitar or in a secured locked position to provide a grip between the clamping block and three threaded base-plate tabs to prevent slippage of the strings while the instrument is being played. The key preferably supplies a hex-head insert for adjustment of the locking screws.

Once a locking screw is properly adjusted, the key can be translated in a linear motion along the clamping block railing and dropped into the next hex-head cavity preferably by a compression spring housed within the key assembly.

Thus, the present invention provides for an adjustable string clamping mechanism which is characterized as being able to efficaciously anchor the strings of a musical instrument by a quick and easy manual operation. No separate tools are necessary for making these adjustments.

In one embodiment of this invention the locking mechanism is mounted behind the fretboard nut and hence, is capable of use on many of the existing stringed instruments. Since the original fretboard nut is retained, the string clamp (locking mechanism) of the present invention can easily be mounted without requiring any special modification to the instrument and without any adversity to the original tone of the instrument. In another embodiment of this invention the locking mechanism or string clamp can be made integral with the musical instrument.

The locking mechanism can be adjusted for locking or releasing the strings of the instrument. The strings are locked in place after being tuned to eliminate constant re-tuning of the strings occasioned by the loosening or slippage of the strings which particularly occurs while playing the instrument. The locking mechanism can also be positioned such that the strings can be released for tuning purposes.

A feature of this invention is the integrally mounted adjusting tool for selectively clamping the strings by a cooperating key that is finger operated. The tool is biased so as to easily fit into the tool receiving slot of the locking nut when properly aligned. The tool is mounted on a carriage that slides on rails provided on the locking mechanism for easy alignment of the tool relative to the locking nut.

An object of this invention is to provide an improved manually operated string locking mechanism for use on a musical stringed instrument. The invention can be implemented by adding it to existing string instruments or it can be made integrally therewith.

Another object of this invention is to provide a combined tool and locking device for use on a musical stringed instrument that is characterized as easy to operate, relatively inexpensive and requires no additional components to lock and release the clamp of the locking device.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
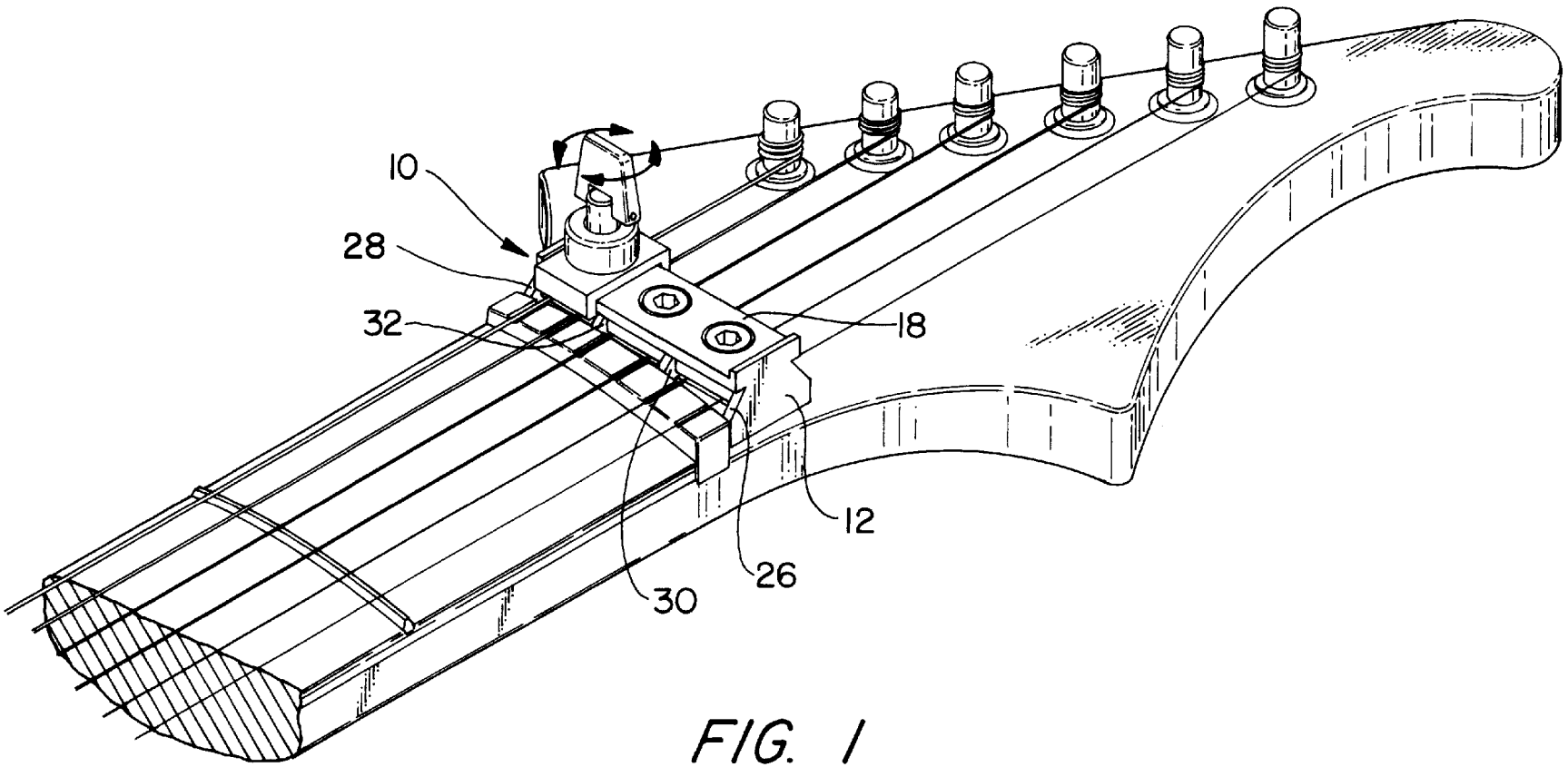
FIG. 1 is a perspective view of the present invention illustrating the locking nut device attached to a six-string guitar.

While the present invention is shown in its preferred embodiment as being utilized on a specific style six-string electric guitar, such is not limiting. Thus, it should be understood that the present invention can be utilized with other styles of six-string electric and acoustic guitars, as well as twelve-string electric and acoustic guitars, as well as various electric and acoustic bass guitars. Furthermore, the present invention can also be utilized with other stringed musical instruments. Accordingly, all of these uses for the present invention are considered within the scope of the invention.

The present invention is best illustrated by referring to FIGS. 1–5 which show the details of the locking mechanism generally indicated by reference numeral 10 being attached to the headstock of a six-stringed guitar. Locking mechanism 10 includes a clamping block 12 that includes a main body sized to fit most guitars. The main body of clamping block 12 can be generally rectangularly shaped having a top wall 18, bottom walls 20 and 21, opposite side walls 22 and 24 and opposite generally triangularly shaped end walls or pillars 26 and 28.

A pair of diametrically opposing axially spaced inner triangularly shaped wall portions or pillars 30 and 32 extending partially laterally between opposite side walls 22 and 24 together with end walls 26 and 28 define three equally axially spaced compartments or passageways 36, 38 and 40 that will be described in more detail hereinbelow.

The top end portions of end walls 26 and 28 extend the distance of opposing side walls 22 and 24, as well as extending a certain distance above top wall 18 to serve as stop members 42 and 46, respectively, at each end of clamping block 12. The function of stop members 42 and 46 will be discussed further below.

Preferably, top wall 18, bottom walls 20 and 21, opposite side walls 22 and 24, end walls 26 and 28, and inner wall portions 30 and 32 are constructed integral to form a one-piece clamping block 12. However, such construction should not be considered limiting, as the various components which form clamping block 12 can also be separate and attached to each other by conventional means. Preferably, clamping block 12 is constructed from a high quality metal such as brass, chrome steel alloy, etc. However, other materials can be utilized to construct clamping block 12 and are considered within the scope of the invention, including materials having characteristics of high strength and high wear-resistance.

Figure 5:
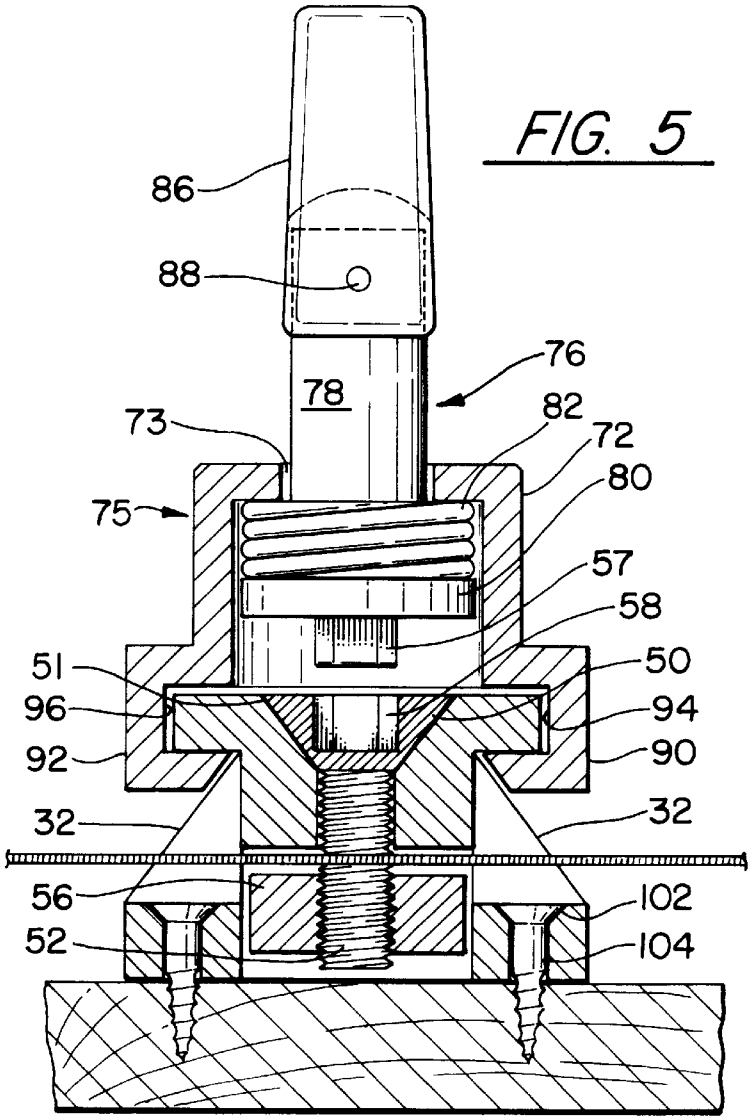
FIG. 5 is the same view as depicted in FIG. 4 illustrating the tool of the locking mechanism in the non-engagement position.
Figure 4:
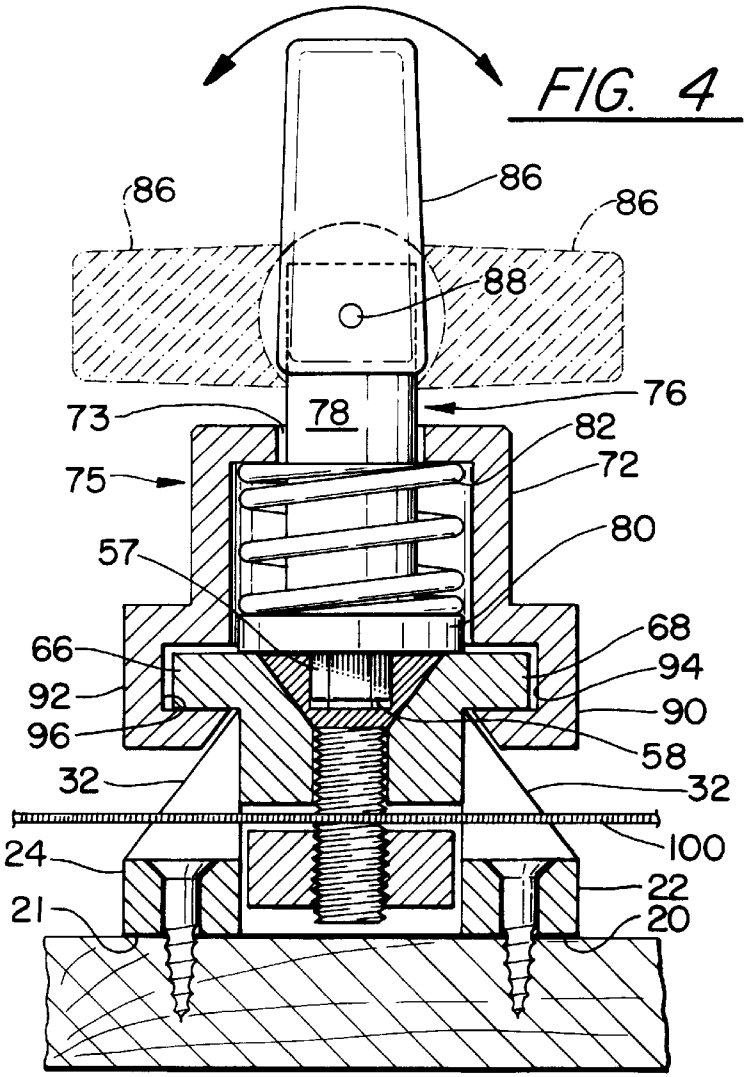
FIG. 4 is a sectional view taken along lines 4—4 of FIG. 3 and illustrates the integrated tool of the locking mechanism in the engagement position.

As best seen in FIGS. 4 and 5, clamping block 12 is attached to the headstock of the guitar, preferably behind the original fretboard nut, by conventional means, such as four flat head wood screws 104. Where four flat head wood screws 104 are utilized, four holes are preferably drilled into the headstock of the guitar and are preferably spaced according to clamping block 12's dimensions which, in turn, can be preferably dimensioned according to conventional locking nut assemblies. These features allow locking mechanism 10 to be retrofitted to any guitar or substituted or replaced with other conventional locking nut assemblies without any reconstruction, alteration or modification to the instrument. The four screws 104 are inserted through four corresponding apertures 102 in bottom walls 20 and 21 of clamping block 12 screwed into the headstock by conventional means, such as a Phillips or regular screwdriver, to securely attach clamping block 12 to the headstock of the guitar.

Centered in each of the passageways 36, 38 and 40 are three flat headed screws 50 that freely pass through three corresponding apertures 51 in the top wall 18 (one aperture for each passageway). As seen in the drawings, in the preferred embodiment, two strings are associated with each passageway, with one string on each side of each screw 50. Since all the screws 50 are identical only one will be described for the sake of simplicity and convenience. A threaded shank portion 52 of screw 50 extends beyond the bottom surface of the top wall 18 and projects into corresponding passageway 36, 38 or 40.

A tab member 56 is freely disposed in passageways 36, 38 and 40 and is threadably attached to the end of the threaded shank portion 52 of each screw 50. Tab member 56 is preferably rectangularly shaped and is large enough to be in close proximity with opposite side walls 22 and 24 so that it can move axially upon rotation of the screw 50, but is constrained from rotating thereby.

A tool receiving slot or cavity 58 which is shown as a hexagonal recess is formed at the top surface of the head portion of screw 50. Though in the preferred embodiment, a hexagonal recess is provided, it should be understood that such is not limiting and other shaped recesses can be utilized and are considered within the scope of the invention. The head portion is preferably counter sunk into top wall 18, so that it together with top wall 18 form a smooth planar surface (see FIG. 2) for permitting easy sliding of the tool assembly discussed in detail below.

As is apparent from FIGS. 4 and 5, opposite portions of the top wall 18 project laterally outward to form opposing guide rails 66 and 68 for sliding longitudinally the finger operated tool assembly 76 between stop members 42 and 46.

The tool assembly 76 comprises a generally circular shaped housing portion 72 which includes a top wall 77 having a central aperture 73 formed therein. Circular shaped housing portion 72 defines a generally circular bore 74 which is in communication with central aperture 73. The tool assembly 76 also includes a carriage unit 75. A tool 76 includes a spindle 78 which extends into bore 74 and projects outwardly beyond top wall 77. An annular flange 80 is formed at the base of spindle 78 and a hexagonal projection or tip 57 that complements the tool receiving slot 58 extends axially beyond flange 80. Tip or insert 57 may be made integral with spindle 78 or may be a separate component that is inserted in a recess formed in spindle 78.

Figure 2:
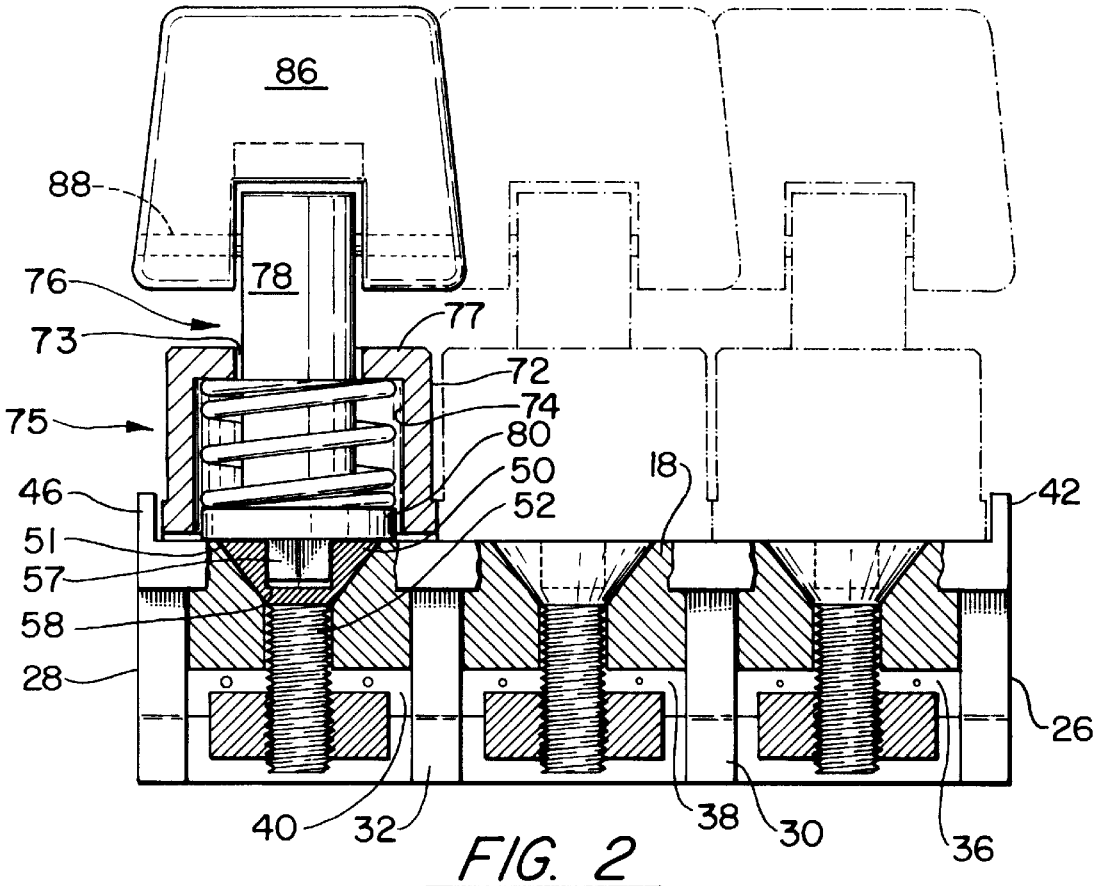
FIG. 2 is a front sectional view of the locking nut device illustrated in FIG. 1.
Figure 3:
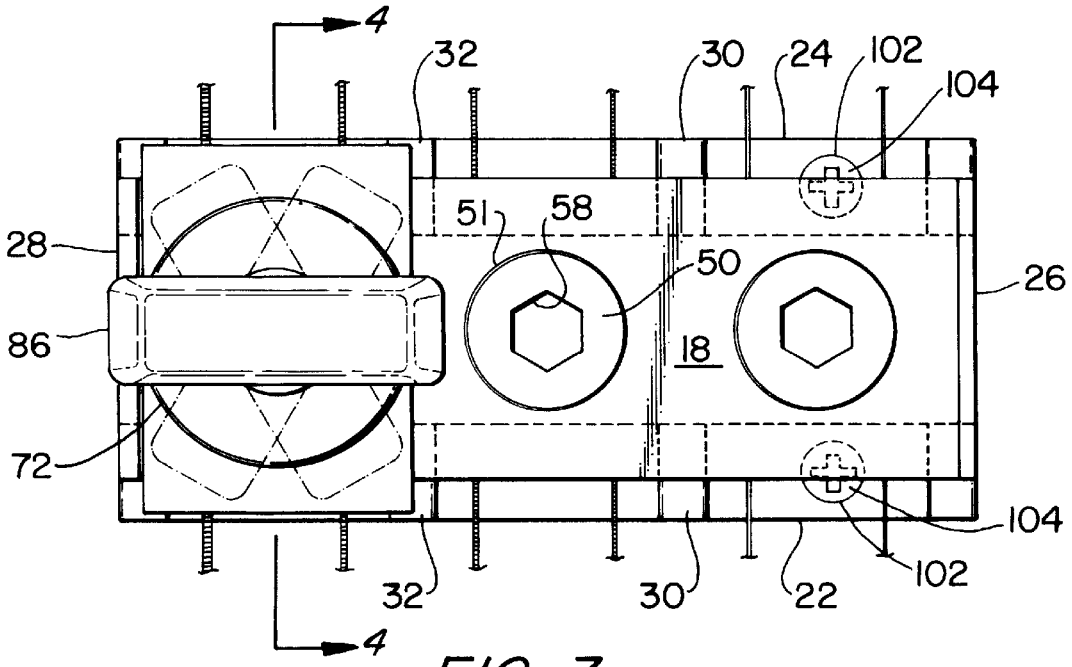
FIG. 3 is a top plan view of the embodiment depicted in FIG. 2.

A helical spring 82 is disposed between a shoulder formed on the underside of top wall 77 and annular flange 80 and is shown in FIGS. 2 and 4 in the deployed position engaging slot 58. A pivotal key or lever 86 is disposed at the opposite end of spindle 78 and is attached thereto by a suitable pin 88 to allow it to rotate into the body of spindle 78, in either direction, and out of the way while the instrument is being played.

Diametrically opposed bottom portions of the carriage unit 75 include the bifurcated sections 90 and 92 that form elongated channels 94 and 96, respectively, that ride along rails 66 and 68. As is apparent from the foregoing, the action of spring 82 biases the spindle 78 downward toward the top surface of the screw 50. When aligned with the tool receiving recess 58, the projecting hexagonal tip 57 fits into recess 58 and is in position to be rotated to position tab member 56.

Rotation of spindle 78 in one direction moves tab member 56 downward to release the force on string 100 which fits between tab member 56 and the bottom surface of top wall 18. Rotation of spindle 78 in the opposite direction positions tab member 56 upwardly to exert a force on string 100 against the bottom surface of top wall 18 to secure string 100 in a locked position. To adjust the next adjacent string or any of the other strings, spindle 78 is lifted upwardly to compress spring 82 and remove the hexagonal projection tip 57 out of the tool recess 58. Simultaneously with the raising of spindle 78, carriage 75 is permitted to freely travel along rails 66 and 68 until tool 76 aligns with the next screw 50 intended to be adjusted.

Preferably, two strings are inserted through each passageway. Thus, during a performance where a string has gone out of tune, only the screw 50 associated with the out of tune string needs to be turned to release the out of tune string and the one adjacent string, also inserted through the same passageway, from the locked position. Accordingly, the remaining strings are not released and remain in their tuned locked position. This feature is very important with six-string guitars, and even doubles in importance for use with a twelve-string guitar. Furthermore, the adjustment tool 76 remains with locking mechanism 10 at all times, and is readily available to the guitarist for quick tuning adjustments.

Figure 6:
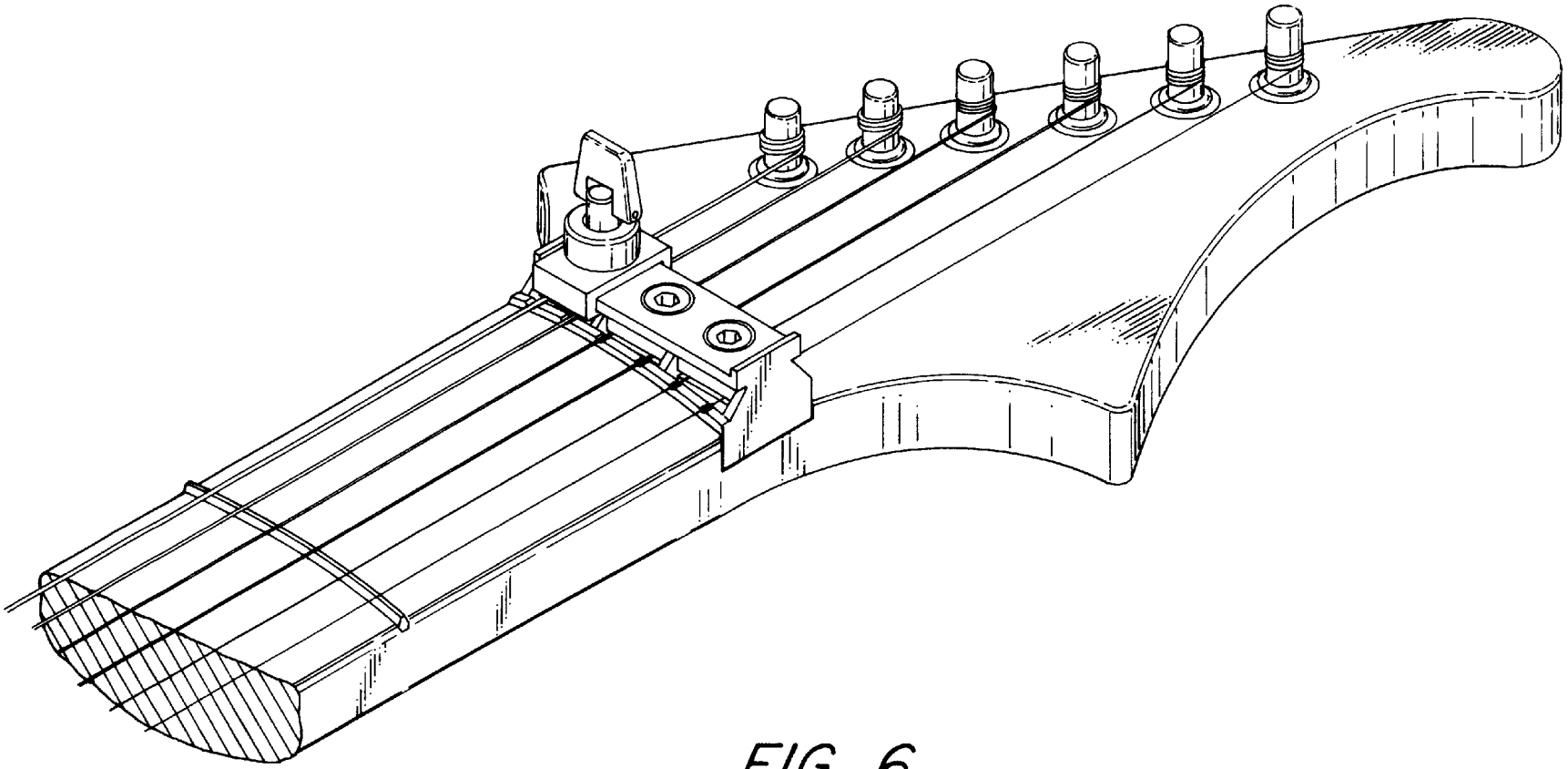
FIG. 6 is a perspective view illustrating the string locking mechanism of the present invention constructed integral with the instrument.

FIG. 6 illustrates an alternative embodiment for the present invention wherein the locking mechanism is mounted or constructed integrally to the guitar. In this embodiment, the bottom walls of the clamping block can also serve as the string guides. In this embodiment, the locking mechanism can be constructed from metal as described above in the first embodiment or can also be constructed from the same or similar material that a guitar and/or headstock is constructed from. Furthermore, other materials can also be utilized and all of the above materials are considered within the scope of the invention.

The locking mechanism of the alternative embodiment can be constructed integral with the guitar by any conventional method. Besides also serving as the string guide, the locking mechanism of the alternative embodiment, operates and functions similar to locking mechanism 10 discussed above.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A mechanism for locking and unlocking strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall; and means for locking and unlocking one or more strings at said passageway, said means for locking and unlocking attached to said clamping block; wherein said means for locking and unlocking comprises:

a screw member attached to the top wall of said clamping block, said screw member having a threaded portion protruding downward into said passageway;

a tab member disposed within said passageway and attached to the threaded portion of said screw member;

means for rotating said screw member to cause said tab member to travel up or down the threaded portion of said screw member, said means for rotating attached to said clamping block and allowed to move horizontally along said clamping block from said first end wall to said second end wall;

wherein a string to be locked by said mechanism is disposed between the top wall of said clamping block and said tab member; wherein rotation of said screw member in one direction causes said tab member to travel up the threaded portion of said screw member closer to the top wall to lock the string and wherein rotation of said screw member in an opposite direction will cause said tab member to travel down the threaded portion of said screw member to unlock the string if the string had previously been locked.

2. A mechanism for locking and unlocking strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall; and means for locking and unlocking one or more strings at said passageway, said means for locking and unlocking attached to said clamping block and remains attached to said clamping block while a user plays the musical instrument;

wherein said means for locking and unlocking comprises:

a screw member attached to the top wall of said clamping block, said screw member having a threaded portion protruding downward into said passageway;

a tab member disposed within said passageway and attached to the threaded portion of said screw member; and means for rotating said screw member to cause said tab member to travel up or down the threaded portion of said screw member;

wherein a string to be locked by said mechanism is disposed between the top wall of said clamping block and said tab member; wherein rotation of said screw member in one direction causes said tab member to travel up the threaded portion of said screw member closer to the top wall to lock the string and wherein rotation of said screw member in an opposite direction will cause said tab member to travel down the threaded portion of said screw member to unlock the string if the string had previously been locked;

wherein said screw member including a screw head having a cavity disposed within and wherein said means for rotating includes an insert member attached to a lever member, wherein when said insert member is disposed within the cavity in said screw head and said lever member is turned by a user to cause said tab member to travel either up or down the threaded portion of said screw member.

3. The mechanism for locking and unlocking strings associated with a musical instrument of claim 2 wherein said cavity having a shape which corresponds to a shape of said insert member.

4. The mechanism for locking and unlocking strings associated with a musical instrument of claim 3 wherein said cavity and insert are hexagonal in shape.

5. The mechanism for locking and unlocking strings associated with a musical instrument of claim 2 wherein said lever member is pivotable.

6. The mechanism for locking and unlocking strings associated with a musical instrument of claim 2 further including means for maintaining said insert within said cavity.

7. The mechanism for locking and unlocking strings associated with a musical instrument of claim 6 wherein said means for maintaining comprises:

a housing member attached to said clamping block, said housing member defining a bore;

a spindle having an annular flange at a first end, said insert attached to the first end of said spindle, said lever member attached to a second end of said spindle, at least a portion of said spindle and said annular flange disposed within said bore of said housing member; and a spring member disposed around said spindle, said spring member disposed within the bore between the annular flange and a top inner surface of said housing member.

8. The mechanism for locking and unlocking strings associated with a musical instrument of claim 7 wherein said lever member is pivotally attached to the second end of said spindle.

9. The mechanism for locking and unlocking strings associated with a musical instrument of claim 3 wherein a top surface of said screw head is virtually flush with a top surface of the top wall of said clamping block.

10. A mechanism for locking and unlocking strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall;

a screw member attached to the top wall of said clamping block, said screw member having a threaded portion protruding downward into said passageway, said screw member including a screw head having a cavity disposed within;

a tab member disposed within said passageway and attached to the threaded portion of said screw member;

means for rotating said screw member to cause said tab member to travel up or down the threaded portion of said screw member, means for rotating includes an insert member attached to a lever member, said cavity having a shape which corresponds to a shape of said insert member;

wherein a string to be locked by said mechanism is disposed between the top wall of said clamping block and said tab member;

wherein to rotate said screw member to position said tab member, said insert member is disposed within the cavity in said screw head and said lever member is turned by a user to cause said tab member to travel either up or down the threaded portion of said screw member;

wherein rotation of said screw member in one direction causes said tab member to travel up the threaded portion of said screw member closer to the top wall to lock the string and wherein rotation of said screw member in an opposite direction will cause said tab member to travel down the threaded portion of said screw member and unlock the string if the string had previously been locked.

11. The mechanism for locking and unlocking strings associated with a musical instrument of claim 10 further including means for maintaining said insert within said cavity, said means for maintaining comprising:

a housing member attached to said clamping block, said housing member defining a bore;

a spindle having an annular flange at a first end, said insert attached to the first end of said spindle, said lever member pivotally attached to a second end of said spindle, at least a portion of said spindle and said annular flange disposed within said bore of said housing member; and a spring member disposed around said spindle, said spring member disposed within the bore between the annular flange and a top inner surface of said housing member.

12. The mechanism for locking and unlocking strings associated with a musical instrument of claim 10 wherein a top surface of said screw head is virtually flush with a top surface of the top wall of said clamping block.

13. A mechanism for locking and unlocking a plurality of strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall;

a plurality of screw members attached to the top wall of said clamping block, each of said screw members having a threaded portion protruding downward into said passageway;

a plurality of tab members, each of said plurality of tab members disposed within said passageway and attached to the threaded portion of a corresponding screw member; and means for rotating said screw members, one at a time, to cause said tab member, associated with the rotated screw member, to travel up or down the threaded portion of said screw member, said means for rotating attached to said clamping block and allowed to move horizontally along said clamping block from said first end wall to said second end wall for properly positioning said means for rotating for use with an intended screw member;

wherein a string to be locked by said mechanism is disposed between the top wall of said clamping block and one of said tab members;

wherein rotation of a screw member in one direction causes a corresponding tab member to travel up the threaded portion of said screw member closer to the top wall to lock the string and wherein rotation of said screw member in an opposite direction will cause said tab member to travel down the threaded portion of said screw member to unlock the string if the string had previously been locked.

14. The mechanism for locking and unlocking a plurality of strings associated with a musical instrument of claim 13 further including at least one inner wall member, said inner wall member extending downward from said top wall of said clamping block to divide said passageway into a plurality of passageway sections, one of said plurality of tab members disposed within each passageway section and attached to the threaded portion of said screw member protruding into the passageway section.

15. A mechanism for locking and unlocking a plurality of strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall;

a plurality of screw members attached to the top wall of said clamping block, each of said screw members having a threaded portion protruding downward into said passageway;

a plurality of tab members, each of said plurality of tab members disposed within said passageway and attached to the threaded portion of a corresponding screw member; and means for rotating said screw members, one at a time, to cause said tab member, associated with the rotated screw member, to travel up or down the threaded portion of said screw member, wherein a string to be locked by said mechanism is disposed between the top wall of said clamping block and one of said tab members;

wherein rotation of a screw member in one direction causes a corresponding tab member to travel up the threaded portion of said screw member closer to the top wall to lock the string and wherein rotation of said screw member in an opposite direction will cause said tab member to travel down the threaded portion of said screw member to unlock the string if the string had previously been locked;

wherein each of said screw members including a screw head having a cavity disposed within and wherein said means for rotating includes an insert member attached to a lever member, said cavity having a shape which corresponds to a shape of said insert member; wherein to rotate a screw member to position a corresponding tab member said insert member is disposed within the cavity in said screw head and said lever member is turned by a user to cause said tab member to travel either up or down the threaded portion of said screw member.

16. The mechanism for locking and unlocking a plurality of strings associated with a musical instrument of claim 15 further including means for maintaining said insert within said cavity of one of said screw members, said means for maintaining comprising:

a housing member attached to said clamping block, said housing member defining a bore;

a spindle having an annular flange at a first end, said insert attached to the first end of said spindle, said lever member pivotally attached to a second end of said spindle, at least a portion of said spindle and said annular flange disposed within said bore of said housing member; and a spring member disposed around said spindle, said spring member disposed within the bore between the annular flange and a top inner surface of said housing member;

wherein said housing member travels along said clamping block to position said means for rotating over a specific screw member to be rotated and once properly positioned said spring member maintains said insert within the cavity of said screw member.

17. The mechanism for locking and unlocking strings associated with a musical instrument of claim 16 wherein said housing member remains attached to said clamping block while the musical instrument is being utilized.

18. The mechanism for locking and unlocking strings associated with a musical instrument of claim 15 wherein a top surface of each of said screw head is virtually flush with a top surface of the top wall of said clamping block.

19. A mechanism for locking and unlocking a plurality of strings associated with a musical instrument, said mechanism comprising:

a clamping block attached to a stringed musical instrument, said clamping block including a top wall and a first end wall and a second end wall, said clamping block having a string passageway extending between said top wall and said first end wall and said second end wall;

a plurality of screw members attached to the top wall of said clamping block, each of said screw members having a threaded portion protruding downward into said passageway;

a plurality of tab members, each of said plurality of tab members disposed within said passageway and attached to the threaded portion of a corresponding screw member; and means for rotating said screw members, one at a time, to cause said tab member, associated with the rotated screw member, to travel up or down the threaded portion of said screw member, wherein a string to be locked by said mechanism is disposed between the top wall of said clamping block and one of said tab members;

wherein rotation of a screw member in one direction causes a corresponding tab member to travel up the threaded portion of said screw member closer to the top wall to lock the string and wherein rotation of said screw member in an opposite direction will cause said tab member to travel down the threaded portion of said screw member to unlock the string if the string had previously been locked;

wherein three screw members are provided and further including a first inner wall member and a second inner wall member, said first and second inner wall members extending downward from said top wall of said clamping block to divide said passageway into three passageway sections, one of said plurality of tab members disposed within each passageway section and attached to the threaded portion of said screw member protruding into the passageway section; wherein each of said screw members including a screw head having a cavity disposed within and wherein said means for rotating includes an insert member attached to a lever member, said cavity having a shape which corresponds to a shape of said insert member, a top surface of each of said screw head is virtually flush with a top surface of the top wall of said clamping block; wherein to rotate a screw member to position a corresponding tab member said insert member is disposed within the cavity in said screw head and said lever member is turned by a user to cause said tab member to travel either up or down the threaded portion of said screw member.

20. The mechanism for locking and unlocking strings associated with a musical instrument of claim 19 further including means for maintaining said insert within said cavity of one of said screw members, said means for maintaining comprising:

a housing member attached to said clamping block, said housing member defining a bore;

a spindle having an annular flange at a first end, said insert attached to the first end of said spindle, said lever member pivotally attached to a second end of said spindle, at least a portion of said spindle and said annular flange disposed within said bore of said housing member; and a spring member disposed around said spindle, said spring member disposed within the bore between the annular flange and a top inner surface of said housing member;

wherein said housing member travels along said clamping block to position said means for rotating over a specific screw member to be rotated and once properly positioned said spring member maintains said insert within the cavity of said screw member, said housing member remaining attached to said clamping block while the musical instrument is being utilized.

* * * * *